United States Patent [19]

Sasayama

[11] 4,282,842

[45] Aug. 11, 1981

[54] FUEL SUPPLY CONTROL SYSTEM FOR INTERNAL COMBUSTION ENGINE

[75] Inventor: Takao Sasayama, Hitachi, Japan

[73] Assignee: Hitachi, Ltd., Tokyo, Japan

[21] Appl. No.: 924,006

[22] Filed: Jul. 12, 1978

[30] Foreign Application Priority Data

Jul. 22, 1977 [JP] Japan ..... 52/87426

[51] Int. Cl.[3] ..... F02D 5/00

[52] U.S. Cl. ..... 123/440; 123/445; 123/478; 123/480; 123/446

[58] Field of Search ..... 123/32 EE, 119 EC, 32 EA, 123/32 EB, 32 EL, 32 EH, 445, 478, 480; 60/276, 285, 32 EA, 32 EG; 364/431

[56] References Cited

U.S. PATENT DOCUMENTS

| | | | |
|---|---|---|---|
| 4,108,122 | 8/1978 | Barnard | 123/119 EC |
| 4,111,171 | 9/1978 | Asano et al. | 123/119 EC |
| 4,112,880 | 9/1978 | Asano et al. | 123/119 EC |
| 4,123,999 | 11/1978 | Asano | 123/119 EC |
| 4,130,095 | 12/1978 | Bowler et al. | 123/32 EE |
| 4,137,877 | 2/1979 | Saho | 123/32 EE |
| 4,201,161 | 5/1980 | Sasayama | 123/32 EB |

*Primary Examiner*—Charles J. Myhre
*Assistant Examiner*—R. A. Nelli
*Attorney, Agent, or Firm*—Craig and Antonelli

[57] ABSTRACT

In a system which detects the condition of an exhaust gas of an internal combustion engine by an exhaust gas sensor and corrects the rate of fuel supply in a feedback control mode, on the basis of the detected condition, the rate of fuel supply is corrected, in response to a particular output of the exhaust gas sensor indicating an optional air-to-fuel ratio of the fuel supply, to a rate of the past fuel supply which occurred at a dead time before detection of the particular output of the sensor, the dead time being corresponding to a time required for a fuel fed into the air inlet pipe to be burned up and then its exhaust gas to reach the sensor.

10 Claims, 11 Drawing Figures

(A) OUTPUT OF CRANK ANGLE SENSOR 10

(B) TERMINAL VOLTAGE OF CAPACITOR 112

(C) TERMINAL VOLTAGE OF CAPACITOR 130

(D) OPENING TIME OF ELECTROMAGNETIC VALVE 134

FUEL SUPPLY CONTROL SYSTEM FOR INTERNAL COMBUSTION ENGINE

BACKGROUND OF THE INVENTION

1. Field of the Invention

This invention relates to a fuel supply control system for an internal combustion engine, and more particularly to a fuel supply control system using feedback control on the basis of an electrical signal obtained from a sensor placed in the exhaust pipe.

2. Description of the Prior Art

The conventionally known fuel supply control system for an internal combustion engine employs a method in which a sensor sensitive to a particular concentration of fuel gas is placed in an exhaust pipe and the air-to-fuel ratio is controlled by feeding the output signal of the sensor back to a fuel supply control apparatus. According to one of the most current methods of this kind, the partial pressure of oxygen in the exhaust gas is measured by using a solid electrolyte such as zirconium oxide and the air-to-fuel ratio is controlled to be set at a value corresponding to the chemically quantitative equilibrium point (hereafter referred to as the theoretical air-to-fuel ratio) determined from the measured partial pressure.

The output of an oxygen sensor indicates whether the air-to-fuel ratio is on the high fuel concentration side or on the low fuel concentration side. According to the output of the oxygen sensor, the control of a fuel supply is performed, correcting the rate of fuel being supplied and approximating the rate always to the theoretical air-to-fuel ratio. In practice, however, some period of time is required from the instant that fuel is supplied from the fuel supply apparatus to the combustion chamber of an engine to be burned therein till the instant that the burned fuel as exhaust gas reaches an oxygen sensor.

Since this period (hereafter referred to as dead time) is rather long, e.g. 0.5–0.1 sec, the actual air-to-fuel ratio will deviate from the theoretical air-to-fuel ratio when the oxygen sensor indicates that the corresponding air-to-fuel ratio has just coincided with the theoretical one.

As described above, according to the conventional method, since the air-to-fuel ratio is obtained from the partial pressure of oxygen in the exhaust gas, there exists a dead time due to the flow of fuel into the combustion chamber, the burning of the fuel injected, and the exhaustion of the burnt gas, as well as the response delay inherent to the feedback control in general. If the loop gain in the control system is raised, hunting of the air-to-fuel ratio as the controlled variable may result, which in turn causes a very unstable state of combustion resulting in an increase in the quantity of harmful waste gases. On the other hand, if the loop gain is greatly suppressed, the response speed of the system becomes very low so that the system will be unadaptable for the use with an internal combustion engine having large transient changes in its operation. In addition, the air-to-fuel ratio fluctuates to increase the harmful waste gases. It is therefore necessary to perform control with the loop gain maintained below the limit at which the system begins hunting, but it is still difficult to choose an adaptive gain since the delay time of the system and the dead time vary depending largely on the state of operation of the engine.

SUMMARY OF THE INVENTION

The object of this invention is to provide a fuel supply control system which is free from hunting and in which the feedback system for correcting the rate of fuel supply in accordance with the output of the exhaust gas sensor is very stable.

According to this invention, which has been made to attain the above object, the rate of the past fuel supply which occurred at the dead time before detection of a particular output of the exhaust gas sensor is regarded as being most suitable and the rate of instant fuel supply or its correcting factor is controlled to be equal to the past fuel supply rate or its corresponding correcting factor. As a result, the excessive overshoot of the controlled variable due to the dead time is suppressed so that the range in which hunting is prevented can be expanded, the fluctuation of the air-to-fuel ratio can be prevented and the generation of harmful waste gases can be suppressed, the response characteristic of the system being improved.

DESCRIPTION OF THE PREFERRED EMBODIMENTS

Figure 1:
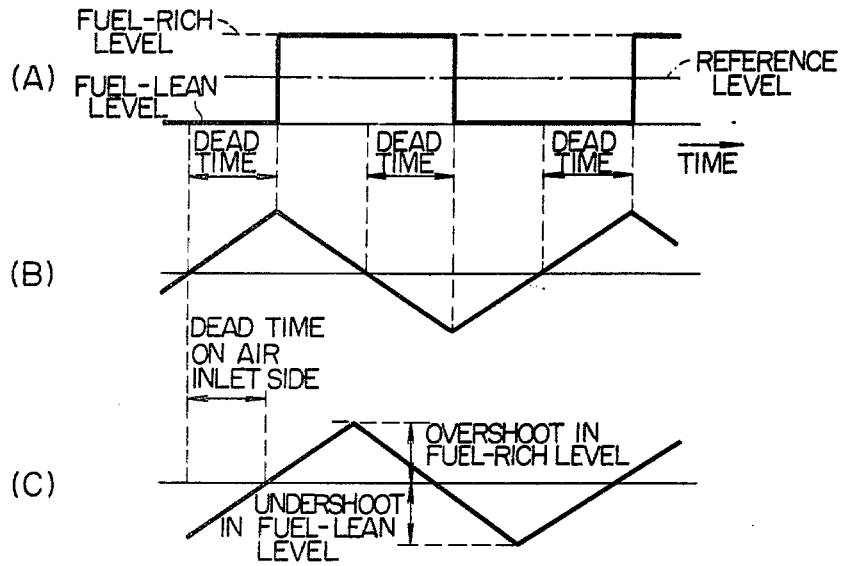
FIG. 1 PRIOR ART
FIG. 1 shows how the rate of fuel supply is controlled according to the conventional methods.

FIG. 1 shows how the conventional control system works which consists mainly of a feedback system including an oxygen sensor. Diagram (A) represents the output of the oxygen sensor. The sensor delivers a high level output when the sensed air-to-fuel ratio takes a fuel-rich value above the theoretical air-to-fuel ratio, and a low level output when the sensed air-to-fuel ratio assumes a fuel-lean value below the theoretical air-to-fuel ratio. Diagram (B) indicates the change with time in the controlled quantity caused by an air-to-fuel ratio regulating device, i.e., in the output of the device. The air-to-fuel ratio regulating device serves to cause the air-to-fuel ratio to increase or decrease at a constant rate with time. The switchover between the increase and decrease takes place each time the output of the oxygen sensor crosses the reference level. Namely, when the output of the sensor leaps from the fuel-lean level to the fuel-rich level, the increase in the ratio is changed to the decrease, and, on the contrary, when the output falls from the fuel-rich level down to the fuel-lean level, the decrease is replaced by the increase. In an engine in operation, there exists a dead time before obtaining actual effects of such a controlled quantity as described above, which dead time corresponds to a delay time related to the spatial distance from the fuel supply apparatus via the combustion chamber to the sensor. The actual air-to-fuel ratio of the air-fuel mixture subjected to combustion in the combustion chamber, lags in phase by the dead time with respect to the controlled quantity shown in the diagram (B), as seen from Diagram (C). The dead time includes a dead time on the intake side equal to the period for which air-fuel mixture gas is sent from the fuel supply apparatus to the combustion chamber, and a dead time on the exhaust side equal to the period for which the burnt gas is sent from the combustion chamber to the oxygen sensor and the sensor responds to the exhaust gas. In general the dead time on the exhaust side is much shorter than the dead time on the intake side and therefore may be neglected.

In the diagram (C) in FIG. 1, the peak values correspond respectively to the overshoot in the fuel-rich level and the undershoot in the fuel-lean level, above and below the mean value. The greater the overshoot or the undershoot, the greater is the quantity of harmful components found in the exhaust gas and the poorer is the stability of operation.

As seen from FIG. 1, the output of the oxygen sensor takes one of two different levels depending on whether the supplied fuel producing the sensed exhaust gas is too rich or too lean compared with the optimum condition thereof. The exhaust gas sensed at the instant when the output of the oxygen sensor changes from one to the other level is regarded as being derived from a fuel supply having the theoretical air-to-fuel ratio. This means that the past controlled quantity for fuel supply which was applied at the dead time before the instant when the output of the oxygen sensor intersects the reference level should be an optimum controlled quantity adapted to achieve substantially the theoretical air-to-fuel ratio of fuel supply. Therefore, according to the invention, the controlled quantity for fuel supply is corrected by using the value of the past controlled quantity, as a reference value. To determine the value of the past controlled quantity at the dead time before, it is necessary to detect continuously the value of the rate of actual fuel supply or the correcting rate and to hold the value by a time equal to the dead time, so that the dead time delayed value of the actual fuel supply rate or correcting rate is available any time when the output of the oxygen sensor changes its level.

Figure 2:
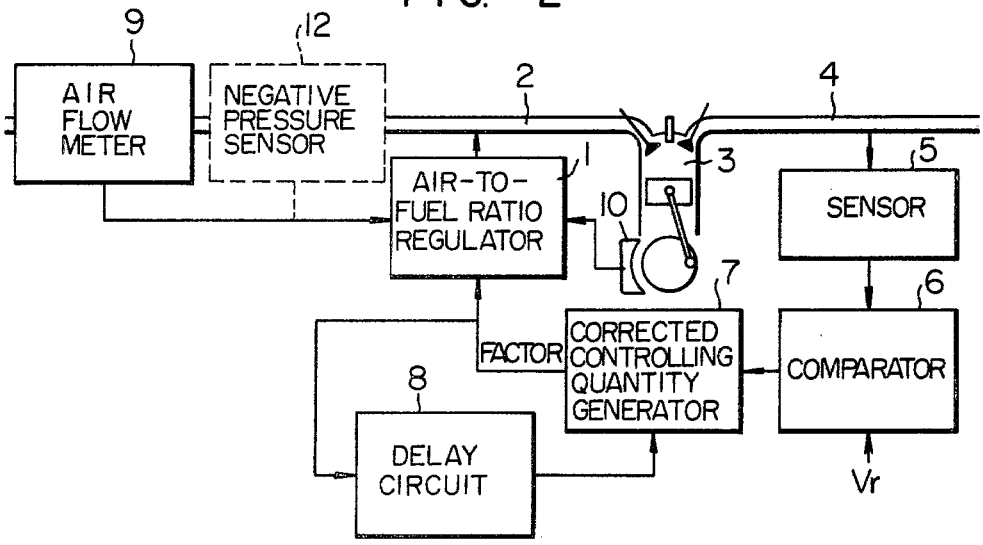
FIG. 2 is a block diagram of a fuel supply control system as an embodiment of this invention.

FIG. 2 is a block diagram of an embodiment of this invention. In FIG. 2, an air-to-fuel ratio regulating device 1 serves to regulate the air-to-fuel ratio in accordance with an electric input. Examples of this device 1 are an electronic fuel injection apparatus in which the opening time of the fuel injection valve is controlled by an electronic circuit, and an electronically controlled carburetor in which the cross sectional area of the fuel or air inlet pipe is changed by controlling the position of the needle valve by current. These devices, which themselves are poor in precision, regulate the rate of fuel supplied with respect to the flow of intake air. An air inlet pipe 2 is provided with an air flow meter 9 and the engine is provided with an engine speed sensor 10. The reference fuel injection quantity $T_p$ is obtained, in a well-known manner, as a function of the output $Q_a$ of the air flow meter 9 and the engine speed N. The fuel supply rate is obtained by multiplying this value $T_p$ with a correcting factor $T_i$ associated with the exhaust gas. The fuel whose rate of supply has been determined as above, is then injected from the air-to-fuel ratio regulator 1 into the air inlet pipe 2. The air-fuel mixture gas whose air-to-fuel ratio has been regulated by the air-to-fuel ratio regulator 1, is conducted to a combustion chamber 3. As well known, the combustion chamber 3 has a gas inlet valve, an ignition plug and a gas outlet valve or an exhaust valve, and causes the air-fuel mixture gas to be ignited and burned therein to convert the resulting change in pressure to dynamic power. The exhaust gas after burning is ejected through the exhaust valve and an exhaust pipe 4. An oxygen sensor 5 using a solid electrolyte such as zirconium oxide is provided in the exhaust pipe 4. The output of the oxygen sensor 5 is received at one of two input terminals of a comparator 6. The other input terminal of the comparator 6 receives a reference voltage $V_r$. The output of the comparator 6 is supplied to a corrected controlling quantity generator 7. The output of the corrected controlling quantity generator 7 is then sent to the air-to-fuel ratio regulator 1 to correct the air-to-fuel ratio. The controlling quantity (corrected controlling quantity) from the air-to-fuel ratio regulator 1, i.e. the electrical quantity for controlling the air-to-fuel ratio (e.g. the opening time of the fuel injection valve of an electronic fuel injection apparatus or the current to the needle valve of an electronically controlled carburetor), is supplied to a delay circuit 8.

Figure 3:
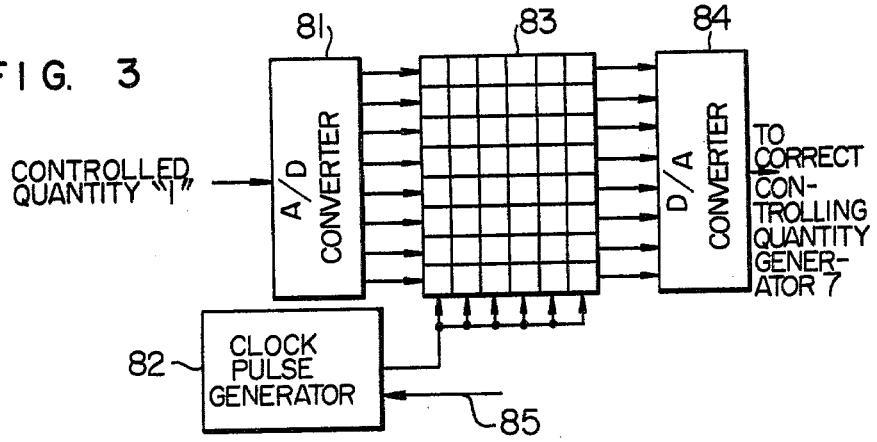
FIG. 3 is a detailed block diagram of a delay circuit used in the embodiment shown in FIG. 2.

FIG. 3 shows an example of the structure of the delay circuit 8. The delay circuit 8 includes an analog-to-digital converter (hereafter referred to as A/D converter) 81, a clock pulse generator 82, a shift register 83, and a digital-to-analog converter (D/A converter) 84. The A/D converter 81 converts the output of the corrected controlling quantity generator 7, which is supplied to the air-to-fuel ratio regulator 1, to digital quantities. The shift register 83 shifts the parallel digital quantities, which are obtained from the A/D converter 81, in synchronism with the output pulses of the clock pulse generator 82.

The dead time is usually determined depending on the rate of flow of intake air. Therefore, a sensor is provided for detecting the rate of flow of intake air, which may be a device having an elastic plate placed in the flow of the intake air. The degree of bending of the plate is dependent on the rate of air flow, and is converted to an electric signal. The electric signal is applied at 85 to the clock pulse generator 82 to change the frequency of the clock pulse according to the air flow rate. As a result, a signal representing the dead time relating to the rate of flow of the intake air can be generated, whereby the control of the fuel supply can be adapted to all the conditions of engine operation.

The D/A converter 84 converts the outputs of the shift register 83 into the form which is easily processed by the corrected controlling quantity generator 7. With the configuration described above, the controlling quantity (the corrected quantity) from the air-to-fuel ratio regulator 1 is retarded by the dead time corresponding to the condition of the engine operation which is determined in accordance with the repetition frequency of the clock pulses, and then received by the corrected controlling quantity generator 7.

Figure 4:
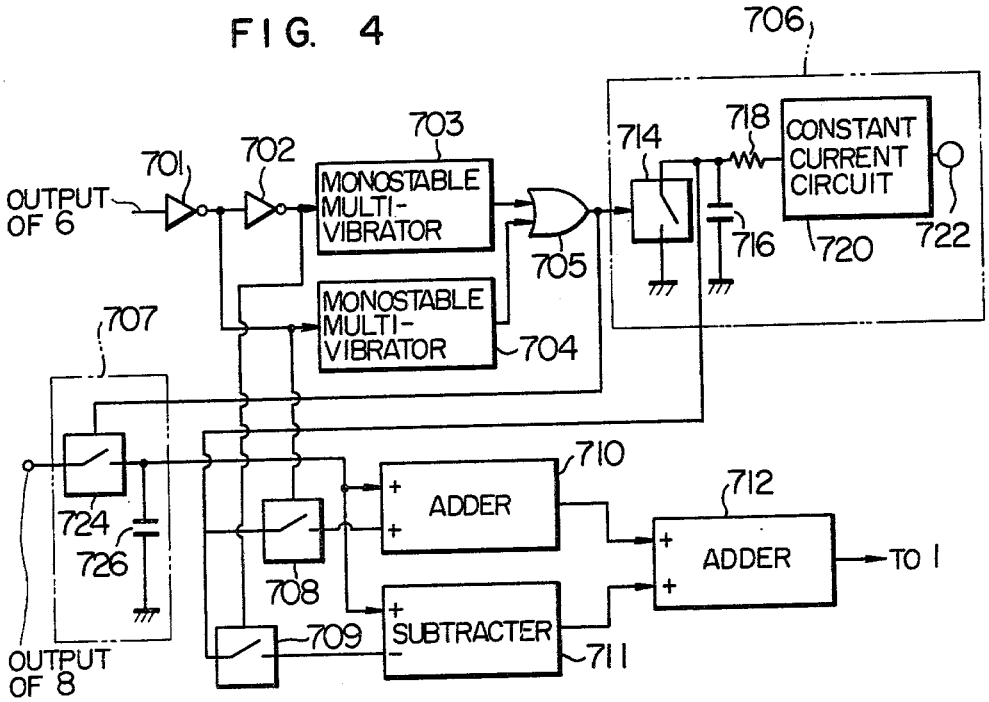
FIG. 4 is a detailed block diagram of a circuit for generating a corrected manipulated variable, used in the embodiment shown in FIG. 2.

FIG. 4 shows a concrete example of the corrected controlling quantity generator 7. The corrected controlling quantity generator 7 includes inverting gates 701 and 702, monostable multivibrators 703 and 704, an OR gate 705, a sawtooth wave generator 706, a sample hold circuit 707, switching circuits 708 and 709, adders 710 and 712, and a subtracter 711. The operation of the circuit shown in FIG. 4 will be described with the aid of the signal waveforms shown in FIG. 5.

Figure 5:
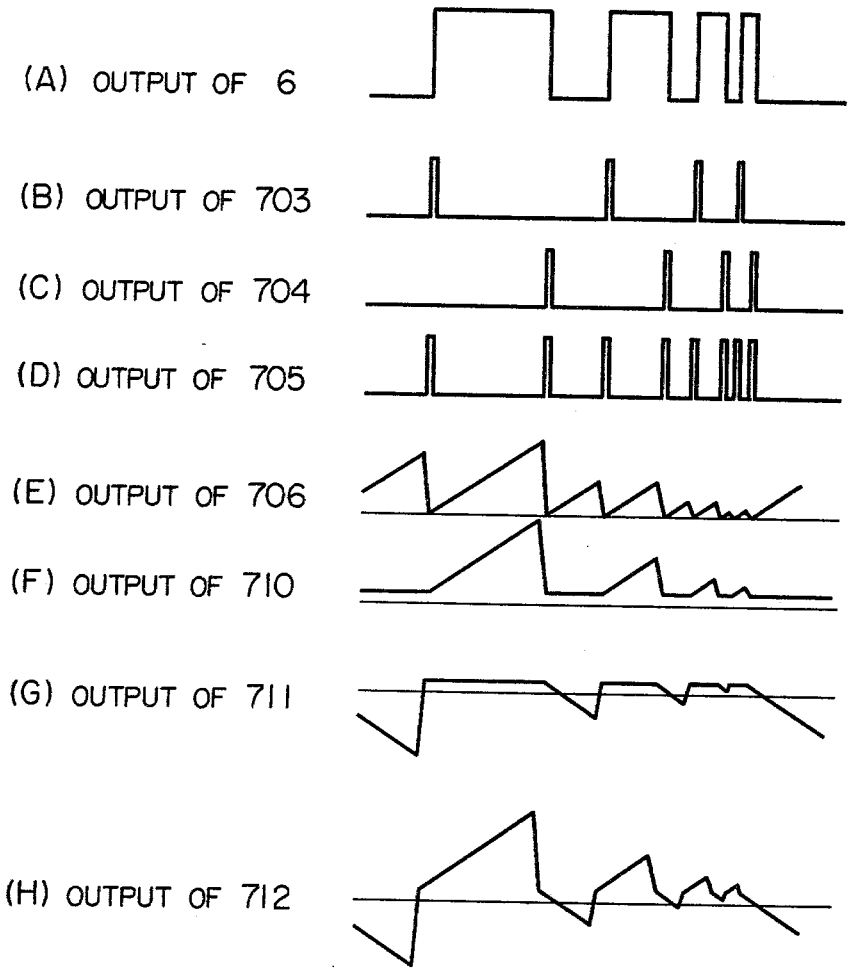
FIG. 5 shows the waveforms useful in explaining the operation of the embodiment of this invention.

The output of the comparator 6 is sent respectively through the inverting gates 701 and 702 to the multivibrators 703 and 704 to trigger them. The outputs of the multivibrators 703 and 704 are sent through the OR gate 705 to the sawtooth wave generator 706. Diagram (A) in FIG. 5 shows that the output of the comparator 6 which is obtained by clipping the output of the oxygen sensor 5 at a predetermined level. Diagrams (B) and (C) designate the outputs of the monostable multivibrators 703 and 704, which are sent through the OR gate 705 to the sawtooth wave generator 706 to trigger the generator 706 and also to the sample hold circuit 707 for storing the output of the delay circuit 8 to serve as a sampling signal. In the sawtooth wave generator 706, the output pulse of the OR gate 705 actuates a switch 714 to completely discharge a capacitor 716 so that the capacitor 716 immediately starts being charged through a resistor 718 by the current from a constant current circuit 720 and that a sawtooth wave increasing at a preset rate of change with time can be delivered. The sample hold circuit 707 stores the value of the controlled quantity (correcting factor) which has occurred in the past by the dead time before the output of the oxygen sensor 5 intersects the reference level by closing a switch 724 only when the OR gate 705 is delivering its output and charging a capacitor 716. The stored value is used as the reference value.

If the output of the comparator 6 has a high level, that is, is of fuel-rich condition, the output of the sample hold circuit 707 and the output voltage of the sawtooth wave generator 706 via the switching circuit 709 are supplied to the subtracter 711. The subtracter 711 delivers the output which is the difference between the output of the sample hold circuit 707 and the output of the sawtooth wave generator 706, and the output is received by the adder 712, the output as the difference being as shown in the diagram (G) of FIG. 5. On the other hand, when the output of the comparator 6 is at a low level, i.e. under the fuel-lean condition, the output of the sample hold circuit 707 and the output of the sawtooth wave generator 706 via the switching circuit 708 are supplied to the adder 710. The adder 710 delivers an output which is the sum of the outputs of the sample hold circuit 707 and the sawtooth wave generator 706, and the output of the adder 710 with the waveform as shown in the diagram (F) of FIG. 5 is received by the adder 712. Therefore, the output of the adder 712 is equal to the output of the subtracter 711 under the fuel-rich condition and to the output of the adder 710 under the fuel-lean condition. As a result, the adder 712 delivers an output having a waveform as shown in the diagram (H) of FIG. 5.

Figure 6:
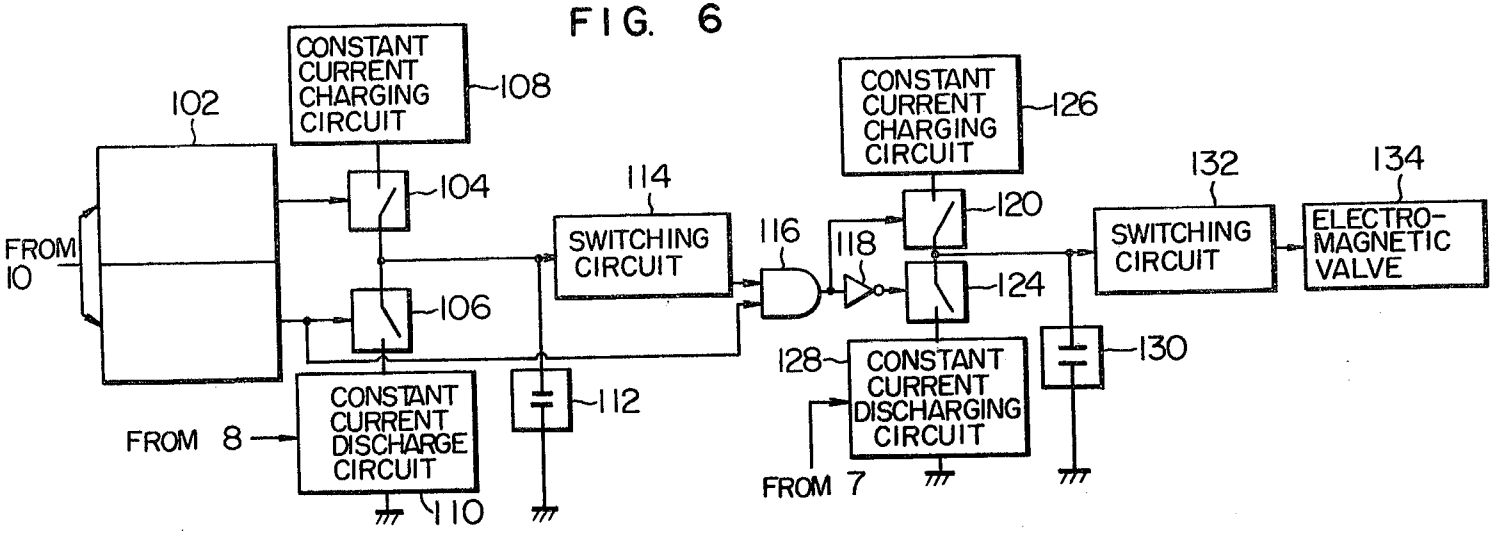
FIG. 6 shows in block diagram an embodiment of an air-to-fuel ratio control device according to this invention.
Figure 7:
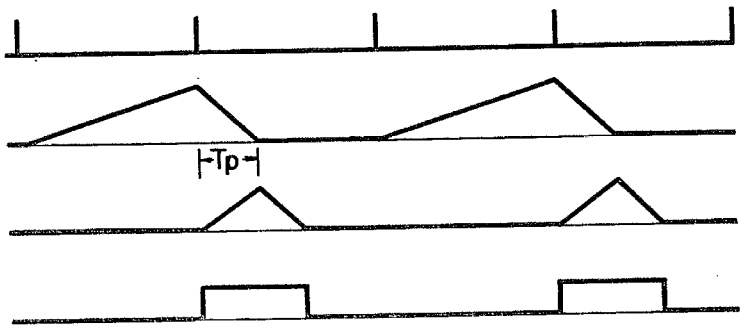
FIG. 7 shows the waveforms useful in explaining the operation of the air-to-fuel ratio control device shown in FIG. 6.

FIG. 6 shows in block diagram a concrete example of the air-to-fuel ratio regulator according to this invention. FIG. 7 shows waveforms useful in explaining the operation of the circuit shown in FIG. 6. Diagram (A) corresponds to the output of a crank angle sensor 10 as a train of pulses generated, for example, every 90° of crank angle. The output of the crank angle sensor 10 is supplied to a flip-flop 102, the outputs of which first turn on a switch 104 and then also turn on a switch 106. The closure of the switch 104 causes a constant current charging circuit 108 to supply a constant current to a capacitor 112 so that the terminal voltage of the capacitor 112 increases at a constant rate, as shown in the diagram (B) of FIG. 7. The electric charge stored in the capacitor 112 is then released forming the output of a constant current discharge circuit 110. The discharging current is determined depending on the output of the air flow meter or the negative pressure sensor. Accordingly, the discharge time $T_p$ is determined depending on the rate of flow of air representing the load on the engine or the negative pressure component. The time $T_p$ is obtained as the output of an AND gate 116 which receives the output of the flip-flop 102 and the output of the switching circuit 114 which delivers an output while electric charges are being stored in the capacitor 112. The output of the AND gate 116 is supplied directly to a switch 120 and through an inverter 118 to a switch 124.

During the time $T_p$, the switch 120 is closed and a constant current flows from a constant current charging circuit 126 into a capacitor 130, so that the terminal voltage of the capacitor increases at a constant rate as shown in the diagram (C) of FIG. 7. As the capacitor stores electric charges therein, a switching circuit 132 delivers an output to open an electromagnetic valve 134 as shown in the diagram (D) of FIG. 7. After the lapse of the time $T_p$, the inverter 118 causes the switch 124 to be closed to discharge the capacitor 130. Since this discharge current is the constant current which is determined at 128 in accordance with the output of the corrected controlling quantity generator 7, the time required for the electric charges stored in the capacitor 130 to be completely released, is determined in accordance with the output of the corrected controlling quantity generator 7. The electromagnetic valve 134 is kept open until the capacitor 130 has discharged completely.

Figure 8:
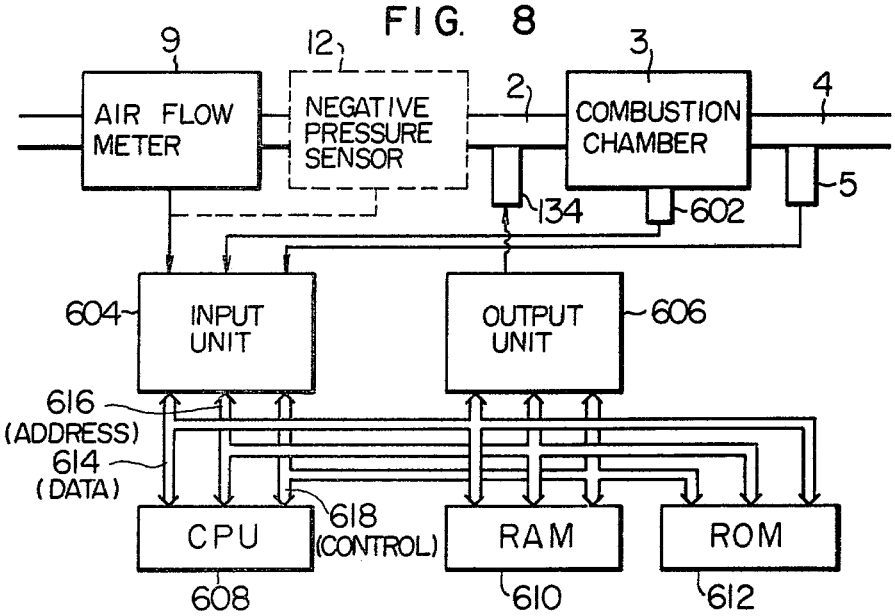
FIG. 8 shows in block diagram another embodiment of this invention.

FIG. 8 shows in block diagram another embodiment of this invention. The rate of flow of air or the negative pressure detected in the air inlet pipe 2 by the air flow meter 8 or the negative pressure sensor 12 is supplied to an input unit 604. Also, the exhaust gas from the combustion chamber 3 is examined by the oxygen sensor 5 provided in the exhaust pipe 4 and the output of the oxygen sensor 5 is supplied to the input unit 604. Further, the output of the rotational speed sensor 602 for detecting the rotational speed of the engine is supplied to the input unit 604. These pieces of information are sent to a central processing unit CPU 608, a random access memory RAM 610 and a read-only memory ROM 612 and the processed data is sent to an output unit 606. The output unit 606 actuates the electromagnetic valve 134 to supply fuel.

The operation of the circuit shown in FIG. 8 will be described with the aid of the flow chart in FIG. 9. An interrupt signal is sent from the rotational speed sensor 602 to the CPU 608 via the input unit 604 and a control bus 618. Accordingly, the program in FIG. 9 proceeds from step 150 to step 152. At the step 152, a judgement is made of whether the interrupt is from the fuel supply control system or not. If this is not the case, that is, the result of the judgement is "no", the program proceeds to the step 172 so that no processing of fuel supply is performed. On the other hand, if the result of the judgement is "yes", the rate QA of flow of intake air or the vacuum pressure signal VA is supplied from the input unit 604 and then stored in the RAM 610 via a data bus 614 at the step 154. The rate QA of air flow or the vacuum pressure VA indicates the condition of load on the engine. Next, at step 156, the rotational speed N of engine is supplied from the input unit 604 and then stored in the RAM 610 via the data bus 614. In accordance with the data QA or VA and N, the reference rate $T_p$ of fuel injection is obtained, at the step 158, from a map which is provided in the ROM 612 and stored with various values of the reference fuel injection rate corresponding to the respective values of the air flow rate QA and the engine speed. The obtained value of the fuel injection reference rate is set in the RAM 610. At step 160, the correcting factor $T_i$ is read out of the RAM 610 and held in the CPU 608 via the data bus while the reference rate $T_p$ is written in the CPU 608. At step 162, the product T of $T_i$ and $T_p$ is calculated. The value T is set in the output unit 606 at step 168. The electromagnetic valve 134 is kept open during a period corresponding to the value T.

Figure 9:
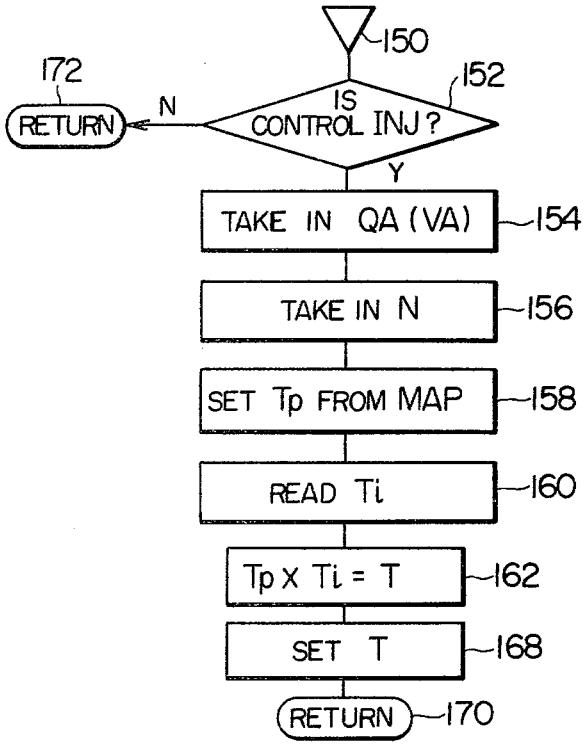
FIG. 9 is a flow chart illustrating the operation of the circuit of the embodiment shown in FIG. 8.

The flow chart shown in FIG. 9 and described above is well known and it is a mere example and may of course be replaced by any other suitable flow chart.

Figure 10:
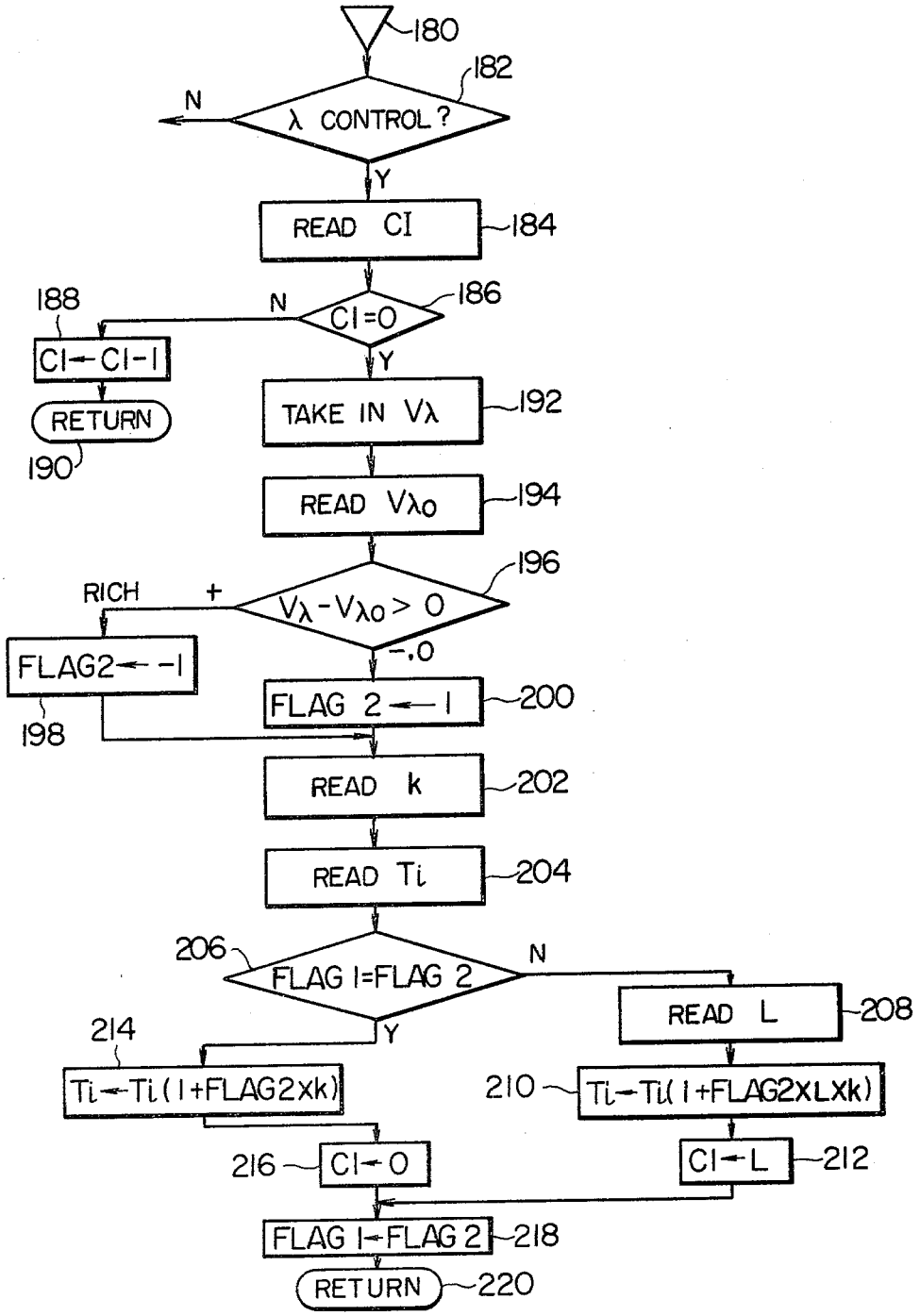
FIG. 10 is a flow chart illustrating how the correcting factor $T_i$ is obtained.

Now, description will be made of how the correcting factor $T_i$ is obtained. In FIG. 10, interrupts occur at regular intervals. Each interrupt lasts for 10 milliseconds. If this interrupt is identified to be associated with the control of the correcting factor (hereafter referred to as λ-control) in accordance with the condition of the exhaust gas (step 182), the count value CI in the RAM 610 is read out (step 184). The CI is then subjected to check (step 186) and if CI=0, the step 192 is reached while if CI is not equal to 0, the step 188 is reached. At the step 188, a new value of CI obtained by subtracting unity 1 from CI is stored in the RAM 610 and the program waits for the next interrupt (step 190). At the step 192, the output of the sensor 5 is taken in via the input unit 604. The value of the theoretical air-to-fuel ratio $V\lambda_o$ is read out of the RAM 610 (step 194) and the difference between the output of the sensor and the value is calculated (step 196). If the difference is positive, the air-fuel mixture gas is considered to be in the fuel-rich state while if the difference is negative, the mixture gas is considered to be in the fuel-lean state. In the fuel-rich case, a value "−1" is set in the FLAG2 in the RAM 610 at step 198. In the fuel-lean case, on the other hand, a value "+1" is set in the FLAG2 in the RAM 610 at step 200. At step 202, the gradient k of the correcting factor $T_i$ is read out of the RAM 610 and at step 204 the correcting factor $T_i$ itself is read out.

Figure 11:
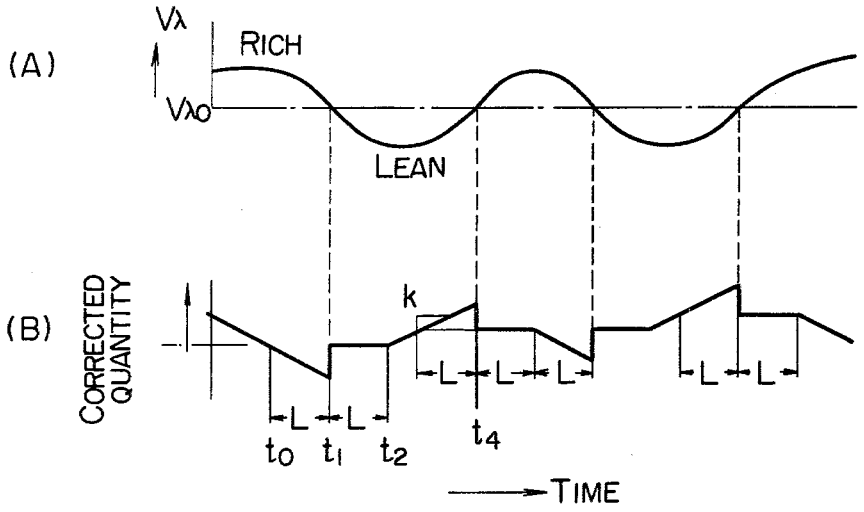
FIG. 11 shows the relationship between the output of the exhaust gas sensor and the corrected variable.

The step 206 checks whether the actual air-to-fuel ratio coincides with the theoretical air-to-fuel ratio or not. If the previous FLAG condition (value in FLAG1) equals the new FLAG condition (value in FLAG2), the actual air-to-fuel ratio coincides with the theoretical value, but if they are different from each other, the actual air-to-fuel ratio coincides with the theoretical one. This is shown on examining the diagrams in FIG. 11.

FIG. 11(A) shows the relationship between the output Vλ of the exhaust gas sensor and the reference value $V\lambda_o$. The region where Vλ is greater than $V\lambda_o$, corresponds to the fuel-rich condition and the region where Vλ is smaller than $V\lambda_o$, gives the fuel-lean condition. It is understood that the actual air-to-fuel ratio of the fuel-air mixture gas coincides with the theoretical value at the instant $t_1$ when Vλ crosses $V\lambda_o$ from fuel-rich side to fuel-lean side, or at the instant $t_4$ when Vλ crosses $V\lambda_o$ from fuel-lean side to fuel-rich side. Therefore, the actual air-to-fuel ratio can be considered to coincide with the theoretical air-to-fuel ratio in the case where FLAG1≠FLAG2 at step 206. FIG. 11(B) shows the change in the corrected quantity. If the coincidence of the actual air-to-fuel ratio with the theoretical value is detected at the instant $t_1$ at step 206, it should be at the instant $t_0$ which was past by the dead time L that the actual air-to-fuel ratio of the injected fuel would coincide with the theoretical air-to-fuel ratio. To make the feedback system stable, the air-to-fuel ratio should resume the value at $t_0$. The corrected quantity of the feedback system should be so controlled that the actual air-to-fuel ratio at the instant $t_1$ may take the value at $t_0$.

However, since the actual air-to-fuel ratio during the period between the instants $t_0$ and $t_1$ deviates from the theoretical value, it is preferable that the corrected quantity is kept constant at $t_1$ and that the feedback system is operated again after a certain period of time (at least the time L) long enough to detect by the sensor 5 the condition of the exhaust gas as the burnt form of the fuel injected at $t_1$. As a result, the corrected quantity begins to change at $t_2$ in accordance with the output of the sensor.

At steps 208, 210 and 212, the value of the corrected quantity at the time L before is obtained. At the step 208, the dead time L is read out of the map in the ROM 612. The dead time L has a certain relation to the rotational speed of the engine. For example, the dead time L is about 0.8 sec, 0.5 sec and 0.3 sec respectively for rotational speeds of 800 rpm, 3000 rpm and 4000 rpm. These values can be determined by actual measurement. These values are stored in the ROM 612 so that they can be read out in accordance with the rotational speed of engine.

A method according to which the feedback by examining the exhaust gas is switched off at low and high speed operations of the engine, may also be proposed. In such a case, the dead time L may be fixed at a value. At the step 210, the corrected rate of fuel supply at a time $t_0$ before the time L is obtained on the basis of the time L and the corrected rate is set in the RAM 610 as a new corrected variable $T_i$. The new correcting quantity $T_i$ is calculated by an equation NEW $T_i = T_i(1 + \text{FLAG2} \times L \times k)$, where $T_i$ is a value of the correcting quantity at the instant when the output of the oxygen sensor changes its level, L the dead time, k a rate in change of the correcting quantity and FLAG2 determines whether the value of Lk is to be added or subtracted.

At the step 212, the value corresponding to the dead time L is set as CI. The value of CI is equal to, for example, the actually measured dead time divided by the interrupt period. After the set of CI at the step 212, it is not until the interrupts whose number of times corresponds to CI are made from the step 184 to the step 188 that the steps after the step 192 inclusive are performed. Accordingly, the corrected quantity meanwhile remains unaltered and is kept at a constant value. Namely, the feedback system is at rest until CI equals zero and the quantity $T_i$ remains constant. This condition is seen between $t_1$ and $t_2$ in FIG. 11.

At the step 206, if FLAG1=FLAG2, the condition of the exhaust gas is considered to remain the same so that the degree of correction must be increased. Thus, the rate k of change is further added at step 214. Namely, the value of the new corrected quantity $T_i$ is made equal to $T_i(1+FLAG2\times k)$. In this case, the feedback system must necessarily operate with the next interrupt. Zero is set as the count CI at 216 and the step 218 is reached. The value of the FLAG2 is set in the FLAG1 to wait for interrupt.

As described above, according to this invention, the controlled quantity is corrected to be equal to the value of the past quantity which was applied at the dead time before the output of the oxygen sensor intersects the reference level, so that the actual air-to-fuel ratio approximates to the theoretical one. Moreover, the deviation of the air-to-fuel ratio to the fuel-rich and fuel-lean sides can always be corrected by simply adding to the controlled quantity the corrected controlling quantity in the opposite sense. Therefore, the system avoids the condition wherein the controlled quantity is erroneously shifted to the fuel-rich side even under the fuel-rich condition, as is often the case with the conventional method. Thus, the response characteristic can be remarkably improved for a certain change in the controlled quantity. For a fixed limit of hunting, the system according to this invention has a greater loop gain than the conventional system so that control gain is improved, the quantity of the harmful waste gases is suppressed, and the operation of the engine is stabilized. Even in the case where the operating conditions of the engine change, that is, the absolute value of the controlled quantity changes with time, the controlling quantity can be corrected after, at most, a period equal to the dead time. This means that the system according to this invention has a very high follow-up ability and therefore that it is eminently suitable for the control of an internal combustion engine for an automobile whose operating condition sometimes changes abruptly.

The above description of this invention is concentrated on some embodiments, but does not mean that this invention is limited to those embodiments alone. For example, in the practice of this invention, a microprocessor including mainly a central processing unit, a temporary storage device and a read-only memory can be used. The use of the microprocessor provides a very versatile configuration. In that case, for example, a discrete function of sample hold such as the delay circuit 8 in FIG. 2 can be eliminated and it suffices instead to store the controlling quantity corresponding to the delay time in the temporary storage device. Moreover, since the microprocessor controls all the components inclusive of the air-to-fuel ratio regulator, the parameter input representing the operating conditions of the engine may be used as the delay time depending largely upon the operating conditions of the engine, and especially the rate of flow of intake air. Further, optimal control is always possible if the dead times in accordance with the various states of engine operation are stored in the read-only memory for timely use.

As described above, according to this invention, there is provided a system for controlling the fuel supply to an internal combustion engine, which system has a high stability and an excellent response characteristic.

I claim:

1. In a fuel control system for an internal combustion engine having an integrating controller and real time feedback producing a correction by changing the air-fuel ratio at a time when it is optimum comprising:

means for detecting the condition of load on said engine;

means for determining the rate of fuel supply in accordance with the output of said load condition detecting means;

means for detecting the condition of the exhaust gas from said engine;

means for correcting said rate of fuel supply to produce said rate in accordance with the output of said exhaust gas condition detecting means; and means for supplying fuel at said corrected rate of fuel supply;

an improvement which comprises:

means for comparing the output of said exhaust gas condition detecting means with a predetermined signal corresponding to an output which would be produced from said exhaust gas condition detecting means if the fuel supply were optimum with respect to the air supply to the engine to produce an output signal when the comparison indicates that the coincidence between the output of said exhaust gas condition detecting means and said predetermined signal has occurred;

means responsive to the output of said comparing means to determine the past condition of fuel supply to the engine which existed at the beginning of a dead time before the occurrence of the output of said comparing means, said dead time being substantially equal to a period of time from the time when fuel is supplied to the engine to the time when the supplied fuel affects the output of said exhaust gas condition detecting means and determined as a function of the condition of load on the engine at the beginning of said dead time, and means for correcting the rate of fuel supply to the engine according to said past condition of fuel supply.

2. A fuel supply control system for an internal combustion engine having an integrating controller and real time feedback producing a correction by changing the air-fuel ratio at a time when it is optimum comprising:

load condition detecting means for detecting the load condition on the engine;

means for determining a reference rate of fuel supply in accordance with the output of said load condition detecting means;

exhaust gas condition detecting means for producing an output voltage representing the exhaust gas condition of the engine;

means for comparing the output voltage of said exhaust gas condition detecting means with a predetermined voltage corresponding to an output voltage which would be produced by said exhaust gas condition detecting means if the fuel supply were optimum with respect to the air supply to the engine, means for determining a first value of a correction factor according to the output of said comparing means, means for correcting said reference rate of fuel supply by said first value of the correction factor thereby correcting the actual rate of fuel supply according to said corrected reference rate of fuel supply, means for detecting the coincidence between the output voltage of said exhaust gas condition detecting means and said predetermined voltage depending on the results of comparison by said comparing means, means responsive to the detection of the coincidence between the output voltage of said exhaust gas condition detecting means and said predetermined voltage for determining a second value of the correction factor which existed at the beginning of a dead time before said detection of the coincidence, said dead time being equal to a period of time from the time when a fuel is supplied to the engine to the time when the fuel supply affects the output voltage of said exhaust gas condition detecting means, and means for applying said second value of the correction factor in place of said first value thereof to said reference fuel supply rate correcting means.

3. A fuel supply control system as claimed in claim 2, wherein said second value determining means includes means for calculating said second value on the basis of the product of said dead time and the time rate in change of said correction factor and an instant value of said correction factor at said detection of the coincidence between the output voltage of said exhaust gas condition detecting means and said predetermined voltage.

4. A fuel supply control system as claimed in claim 2, further comprising means for holding said second value of the correction factor for a predetermined period of time and for continuing the application of said second value to said reference rate correcting means for said predetermined period of time.

5. A fuel supply control system for an internal combustion engine having an integrating controller and real time feedback producing a correction by changing the air-fuel ratio at a time when it is optimum comprising:

exhaust gas condition detecting means for detecting the condition of the exhaust gas from the engine;

means for controlling the fuel supply to the engine in accordance with a load condition of the engine and a correction factor of fuel supply;

first means for determining in accordance with the output of said exhaust gas condition detecting means whether the actual air-to-fuel ratio is on the fuel-rich side or on the fuel-lean side;

means for periodically operating said first determining means;

second means for determining whether the output of said first means in each operation cycle is the same as the output of said first means in the preceding operation cycle, said output indicative of the actual air-to-fuel ratio being on the fuel-rich side or the fuel-lean side;

means responsive to the output of said second determining means indicating that the output of said first determining means in each operation cycle is the same as that in the preceding operation cycle for changing the correction factor of fuel supply in a direction to make the air-to-fuel ratio greater in the same sense of fuel-rich or fuel-lean as that represented by said output of said first determining means; and means responsive to the output of said second determining means indicating that the output of said first determining means in one operation cycle is not the same as that in the next operation cycle for obtaining a past value of said correction factor which was applied to said fuel supply controlling means at the beginning of a prior dead time and applying said past value of the correction factor to said fuel supply controlling means during said each operation cycle.

6. A fuel supply control system as claimed in claim 5, wherein said periodically operating means comprises means for periodically producing a series of interrupt signals, means for counting the number of said interrupt signals and means for initiating the operation cycle of said first determining means when the counts of said counting means reach a predetermined value.

7. A method for controlling the fuel supply for internal combustion engines having control by integration and having real time feedback in which the basic fuel supply to the engine is determined according to the load condition of the engine and corrected by changing the air-fuel ratio at a time when it is optimum according to the condition of the exhaust gas sensor, said method comprising:

determining in accordance with the output of the exhaust gas condition sensor whether the actual air-to-fuel ratio is of fuel-rich or fuel-lean condition;

periodically producing a series of operation signals;

receiving and storing the result of the determining step in response to each of the operation signals;

comparing the stored result of the determining step with the new result of the same step received in response to the next operation signal;

correcting a value of said correction factor, when said stored result of the determining step is the same as said new result of the same step, in a direction to make the air-to-fuel ratio greater in the same sense of fuel-rich or fuel-lean as that indicated by said new result and correcting the basic fuel supply by said correct value of the correction factor; and obtaining, when said stored result of the determining step is not the same as said new result of the same step, a past value of the correction factor which was applied a period of time equal to the preceding dead time, said dead time being equal to a period of time from the time when a fuel is supplied to the engine and the time when the supplied fuel affects the output of the exhaust gas condition sensor and determined as a function of the load condition of the engine at that instant, and correcting the basic fuel supply by said past value of the correction factor.

8. A method for controlling the fuel supply for internal combustion engines having control by integration and having real time feedback in which the basic fuel supply to the engine is determined according to the load condition of the engine and corrected by changing the air-fuel ratio at a time when it is optimum according to the condition of the exhaust gas sensor, said method comprising:

periodically producing a series of control signals;

receiving the output of an exhaust gas condition sensor in response to each of said control signals;

determining from each of the received outputs of the exhaust gas condition sensor whether the actual air-to-fuel ratio is at the fuel-rich condition or the fuel-lean condition;

comparing an old result obtained by the determining step from one of the received outputs of the exhaust gas condition sensor with a new result obtained by the determining step from the next one of the received outputs;

correcting the value of the correction factor, when said old result is the same as said new result, so as to change in a direction determined by said new result;

obtaining, when said old result is not the same as said new result, a past value of the correction factor which was applied at the beginning of a dead time before, said dead time being equal to a period of time from the time when a fuel is supplied to the engine to the time when the supplied fuel affects the output of the exhaust gas condition sensor and determined as a function of the load condition of the engine at that instant, and correcting the value of the correction factor into said past value.

9. A method as claimed in claim 8, further comprising periodically producing a second series of control signals at a frequency different from that of said first series of control signals;

holding said corrected value of the correction factor; and correcting the basic fuel supply in synchronism with said second control signals by using said corrected value of the correction factor held at that instant.

10. A method as claimed in claim 8, further comprising:

setting a predetermined period of time by using said series of control signals when said old result is not the same as said new result;

counting the number of said control signals for determining whether said predetermined period of time has lapsed or not; and continuing the correction of the basic fuel supply by said past value of the correction factor until said predetermined period of time has lapsed.

* * * * *